US005209364A

United States Patent [19]

LaPoint, Jr.

[11] Patent Number: 5,209,364

[45] Date of Patent: May 11, 1993

[54] COLLAPSIBLE CONTAINMENT SYSTEM

[76] Inventor: John LaPoint, Jr., P.O. Box 1667, Lewiston, Me. 04241-1667

[21] Appl. No.: 774,622

[22] Filed: Oct. 10, 1991

[51] Int. Cl.[5] ..... B65D 25/14

[52] U.S. Cl. ..... 220/4.28; 220/4.29; 220/6; 220/461; 220/904; 229/125.36; 383/104; 383/109

[58] Field of Search ..... 383/119, 104, 109; 229/125.36, 125.38, 125.01; 220/4.23, 4.29, 6, 403, 416, 461, 651, 464, 463, 462, 1.5, 904, 4.28

[56] References Cited

U.S. PATENT DOCUMENTS

| | | | |
|---|---|---|---|
| 278,851 | 6/1883 | Bauer | 229/125.38 |
| 1,278,806 | 9/1918 | Wheildon | 220/904 |
| 1,576,147 | 3/1926 | Shell | 220/904 |
| 2,006,673 | 7/1935 | Crawford . | |
| 2,507,939 | 5/1950 | Smith | 383/904 |
| 2,754,869 | 7/1956 | Bartels | 220/904 |
| 2,773,636 | 12/1956 | Williams et al. | 383/119 |
| 3,065,895 | 11/1962 | Lipschutz et al. | 220/403 |
| 3,101,839 | 8/1963 | Holman | 220/403 |
| 3,601,172 | 8/1971 | Bourquin | 220/4.28 |
| 3,896,991 | 7/1975 | Kozlowski et al. | 383/119 |
| 4,493,109 | 1/1985 | Nattrass | 383/119 |
| 4,509,645 | 4/1985 | Hotta | 220/DIG. 9 |
| 4,738,547 | 4/1988 | Brown | 383/119 |
| 4,903,859 | 2/1990 | Derby et al. | 220/462 |
| 4,909,410 | 3/1990 | Derby et al. | 220/461 |
| 5,002,401 | 3/1991 | Blackman | 383/119 |

FOREIGN PATENT DOCUMENTS

| | | | |
|---|---|---|---|
| 184097 | 8/1922 | United Kingdom | 229/125.38 |

*Primary Examiner*—Stephen Marcus
*Assistant Examiner*—S. Castellano
*Attorney, Agent, or Firm*—Lorraine Donaldson

[57] ABSTRACT

A collapsible container that incorporates the features of a rigid free-standing container with the flexibility and collapsibility of a bulk bag. Stiffening members are placed into pockets created by sewing together two pieces of woven polypropylene. The members may be removed and placed inside the bag for shipping and then installed in the sewn pockets to create a collapsible container suitable for containment and shipment of bulk materials of up to 70% liquid composition.

5 Claims, 5 Drawing Sheets

COLLAPSIBLE CONTAINMENT SYSTEM

BACKGROUND OF THE INVENTION

1. The Field of the Invention

The present invention relates to a collapsible bulk storage containment system that has the rigid features of a fiber board box along with the flexibility or collapsibility and liquid integrity.of a bulk bag.

2. The Prior Art

Previously manufactured bulk shipping containers have either used a bag approach or rigid container approach, both of which have their advantages and their disadvantages. The bag type containers are easily shipped and stored in an empty condition, but frequently they generally do not have sufficient rigidity, especially when filled with liquid or fluent material, to allow stacking of the filled containers. They also have presented problems in loading and particularly in unloading in that they easily shifted relative positions during transport making it substantially impossible to unload them with mechanical devices, such as fork lifts, without penetrating the bags. The rigid containers clearly have sufficiently rigid structure to allow stacking when filled or partially filled with liquid or fluent material, but they cannot be collapsed and thus take up a lot of room for transportation and storage when empty. Many of the known bag and rigid containers do not have any provision for compartmentalization of the storage region in order to provide for multiple materials to be loaded in the container in segregated fashion.

One recent attempt to overcome the above mentioned difficulties is found in U.S. Pat. No. 4,903,859. This patent discloses a container which is made from two layers of flexible material which form a pocket therebetween. At least two rigid members are inserted into these pockets to form opposing rigid side walls when the container is assembled. The top and bottom of the container are closed by excess material, there being no top and bottom members or portions as such. A somewhat similar approach is found in U.S. Pat. No. 3,896,991.

SUMMARY OF THE INVENTION

The present invention concerns a containment system for transporting fluent materials, which system has the rigid features of a fiber board box and the flexibility and collapsibility of a bulk bag. The system has a plurality of wall assemblies, each formed from inner and outer layers of flexible liquid tight material joined along three edges to define a pocket therebetween. A stiffening member is sealed in the pocket on the fourth side with the inner layer extending to form a loading chute/closure and the outer layer extending to form a closure flap. The side assemblies are closed at their lower ends by a double wall bottom of the same material as the side wall layers. A cover member is provided to close the container by engagement with the closure flaps.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
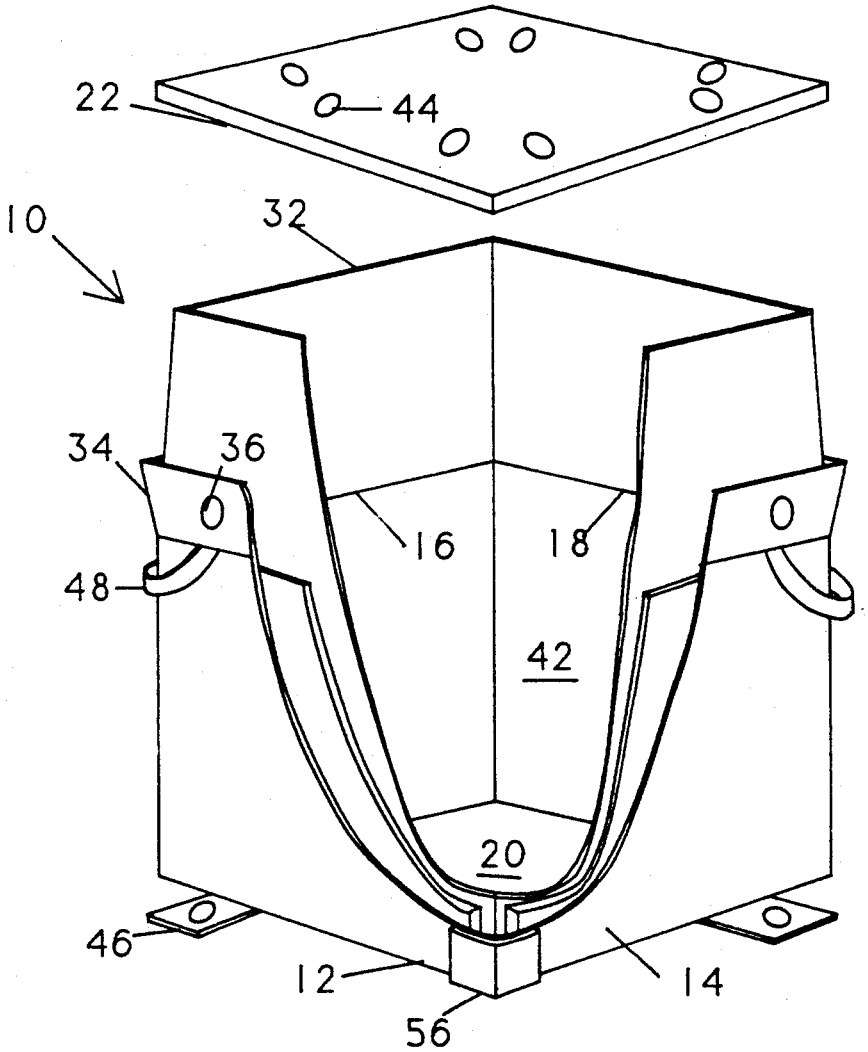
FIG. 1 is a partially exploded diagrammatic perspective view, partially broken away and in section, showing the subject container in an opened condition ready for loading.
Figure 2:
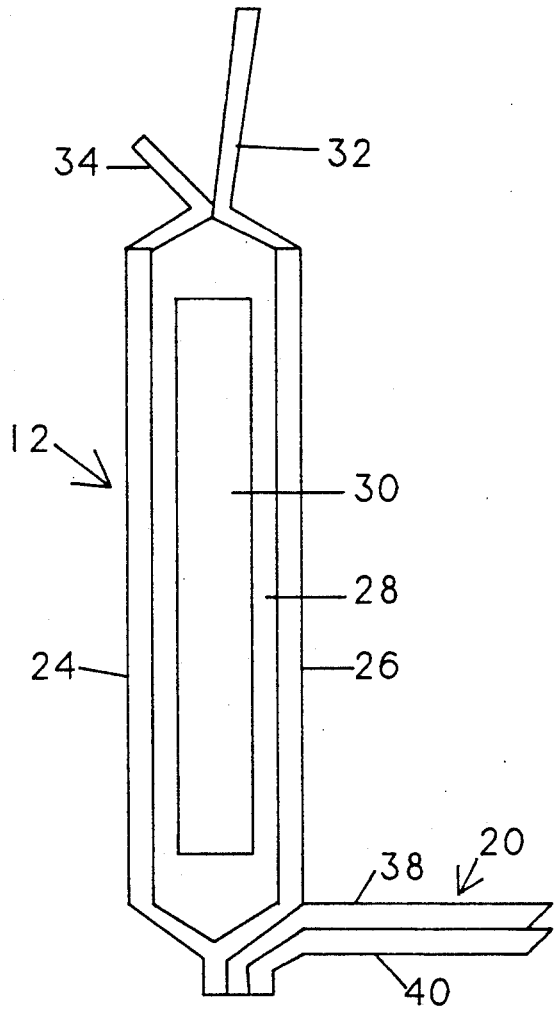
FIG. 2 is a vertical section through a side wall assembly.
Figure 3:
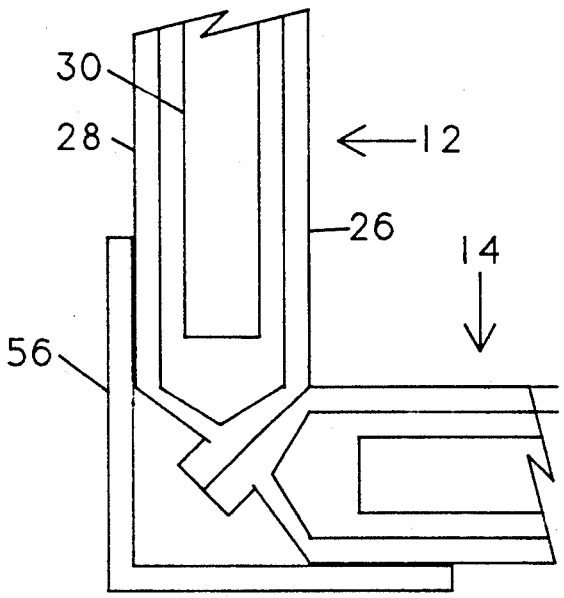
FIG. 3 is a detailed horizontal section through a corner of the subject container.
Figure 4:
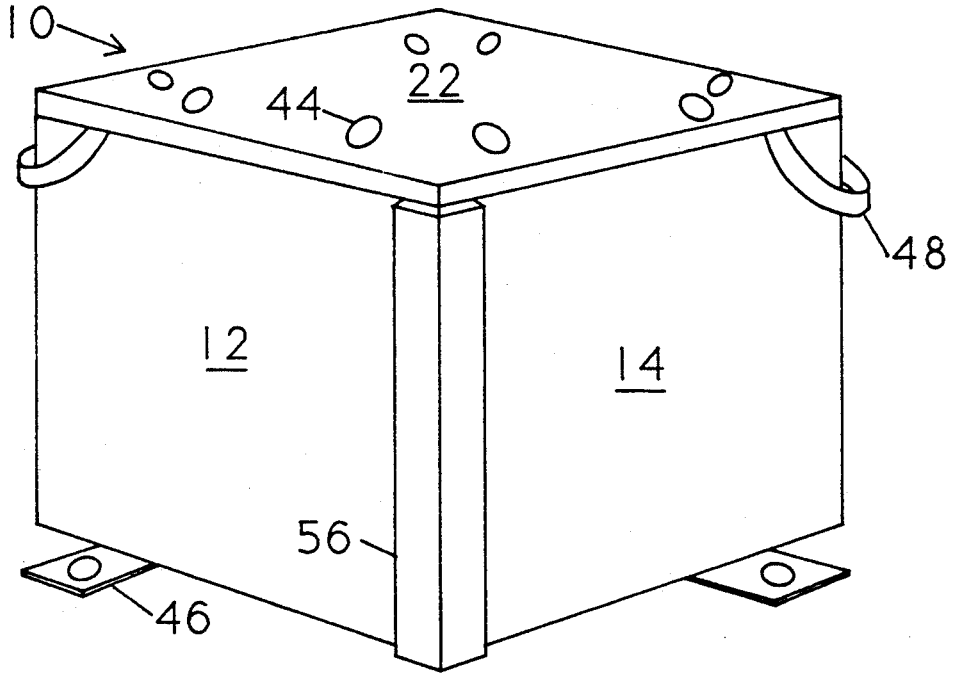
FIG. 4 is a diagrammatic perspective view of the subject container in a loaded and closed condition.

The preferred embodiment of the invention is shown in FIG. 1 in a diagrammatic perspective with parts broken away to see the interior of the container. The subject container 10 has been shown with a generally cubic shape having side wall assemblies 12, 14, 16, 18 bottom 20 and cover member 22. The wall assemblies (see FIG. 2) are preferably fabricated of inner and outer layers of woven liquid tight material 24, 26, such as polypropylene. The layers of each wall assembly are joined at three of their lateral edges by sewing or fusing (not shown) forming pockets 28 therebetween. A stiffening member 30 is inserted into each side wall pocket. The stiffening member 30 is preferably formed from triple wall or similar material, and is inserted into the pockets to ensure the structural rigidity of the filled containment system. The two layers are joined together above the stiffening member with the inner layer continuing to form a filling spout and closure 32 and the outer layer a somewhat shorter closure flap 34. The flap 34 is provided with a spaced array of grommets 36. The bottom is preferably formed of a double layer 38, 40 of the same material as the side wall assemblies and the periphery thereof is secured to the respective bottom edges of the side wall assemblies in the same fashion as the side wall assemblies are joined together. The side wall assemblies and the bottom form the container and define therebetween the material receiving cavity 42.

The cover member 22 is substantially the same size as the bottom 20 and is provided on its periphery with a spaced array of grommets 44, each aligned with a respective grommet 36 of the side wall flaps. The cover member can be either rigid or flexible and preferably is formed from the same material as the rest of the container.

The subject container may further be provided with a plurality of tie down means 46, in spaced array along its lower edge. These can be used to secure the subject container to a pallet (not shown). Similarly, a plurality of lifting loops 48 can be provided at it's upper edge, preferably adjacent the corners where they will be out of the way during filling and emptying of the container and most useful when moving the filled container. These will allow the subject container to be gripped and lifted by mechanical means, such as a fork lift.

Figure 8:
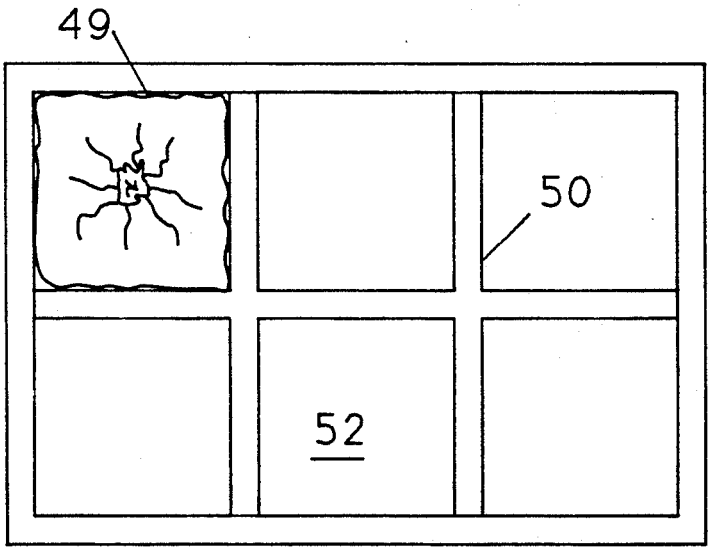
FIG. 8 is a diagrammatic top plan showing an alternate embodiment of the present invention which allows segregated materials to be placed in a single container.

The invention may be provided with an inner liner (not shown) which is preferably form fitting within the material receiving cavity 42. The container may also be provided with an insert 50 (see FIG. 8) forming separate compartments 52 within the container 10, each compartment then receiving therein a flexible bag (not shown) filled with a material to be transported in segregation form the rest of the material in the container.

Figure 7:
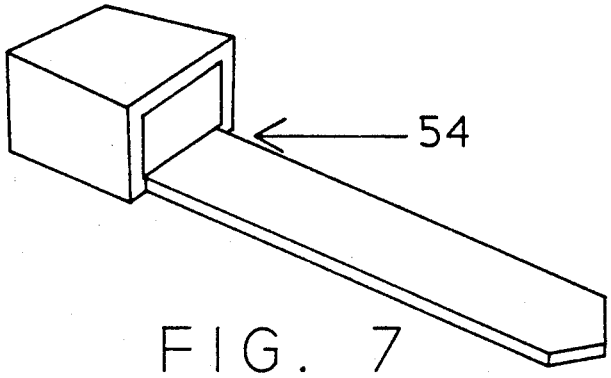
FIG. 7 is a perspective view of a tie of the type used with the present invention.

Once filled, the filling spout 32 is closed upon itself and tied with a tie means 54, thus ensuring that the contents of the material receiving cavity 42 cannot escape or leak out. The contents of the container 10 are further protected by closing and joining of the cover member 22 to the closure flaps 36 by means of additional tie means 54 passing through the respective grommets 36, 44. The tie means 54 (FIG. 7) may be any one of the many readily available one-way plastic ties currently available from multiple sources. They generally have an elongated plastic tail portion extending from a body having a through passage. The tail is wrapped around the object to be secured and inserted through the passage where it is secured against withdrawal.

Figure 5:
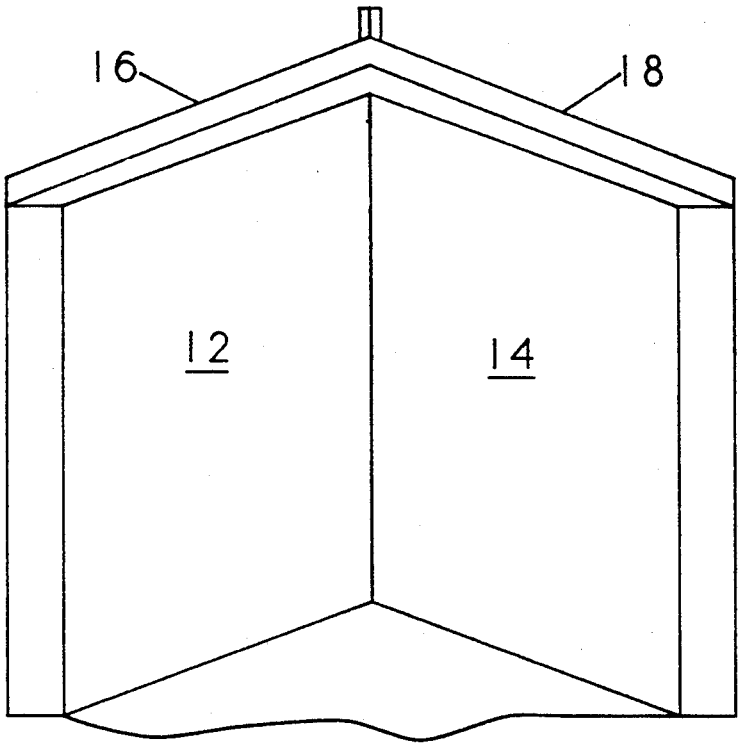
FIG. 5 is a diagrammatic perspective view of the subject container collapsed upon itself during folding for storage.
Figure 6:
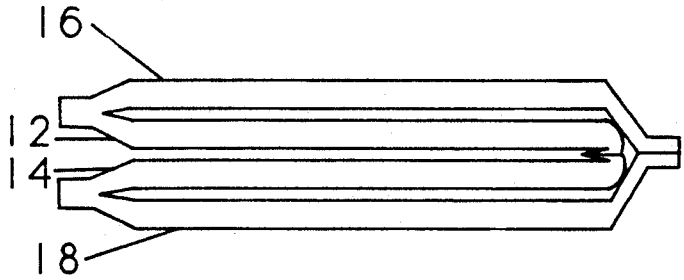
FIG. 6 is a diagrammatic side elevation of the subject container in a collapsed and folded condition.

The present invention utilizes a panel pocket construction to provide a collapsible container which may be collapsed for storage or shipment when empty. When it is desired to collapse the empty container, for storage or shipping, the container is collapsed upon itself (see FIG. 5) so that the container may be shipped in a flattened condition (see FIG. 6).

One alternate embodiment of the subject collapsible container allows formation of separate compartments within the container (FIG. 8) to isolate the contents. The configuration of the insert is dependent upon the number of different materials that must be separated. If the container is compartmentalized, each compartment may have a form-fitting liner or bag (not shown) installed therein. Once filled, the liner(s) is closed with a one-way tie, much in the same manner as the closure of the primary container. The cover member is placed on the container and secured thereto using one-way ties placed through the grommets on the cover member and closure flaps.

The present invention further has handles 48 disposed on the upper corners of the container in such a manner that the assembled and filled container may be lifted and carried by means, such as a forklift. The container further has hold-down tabs disposed along the bottom edge so that the container may be attached to a fixed shipping means, such as a pallet. Corner sleeves (not shown) may be installed to add rigidity and protection for the corners and to further make possible the stacking of multiple containers.

The subject container is moisture and water resistant so that it may be filled with bulk materials having a consistency of up to seventy percent (70%) liquid sludge.

The present invention has been presented in its basic form. It is well within the preview of the invention to make such changes as would be apparent to the skilled artisan. For example, two side wall assemblies could be made integral with and extending from opposite sides of the bottom with two further side wall assemblies joined thereto to make the final container. Also it would be possible to make the filling chute a single member which is then joined to the upper edge of the side assemblies of the container. The same could be done with the closure flap. A wide variety of materials are available for manufacture of the subject container, the material selection being determined by the intended contents to be contained therein. It would further be possible to construct the present invention with more than four sides, an even number of sides being necessary for collapsing the container, to provide a means for contents identification. This could also be accomplished by material color.

The present invention may be subject to many modifications and changes without departing from the spirit or essential characteristics of the invention, the scope of which is defined by the appended claims.

What is claimed is:

1. A collapsible containment system for handling materials having a non-stable consistency, such as a slurry, said system comprising:

a container having at least four side assemblies each joined to each other along their adjacent edges, each said side assembly having top, bottom and side edges formed by inner and outer layers of woven liquid tight material, each side assembly joined along the bottom and side edges defining a pocket therebetween, said layers joined to each other on an upper seam spaced from the top edges of the respective layers, the inner layer having greater length than the outer layer on the top edges, said inner layer is joined to form a loading sleeve, said outer layer having a first plurality of grommets spaced therealong in a patterned array and is joined to form a closure flap;

a stiffening member of three ply material positioned in each respective pocket of each said side assembly;

a bottom formed of two plys of said woven material and joined to the bottom edge of each said side assembly, said bottom and said side assemblies defining therebetween a material receiving cavity; and a top member having a second plurality of grommets spaced along the entire periphery thereof, each said grommet of said second plurality being aligned with a respective grommet of said first plurality on a respective side assembly closure flap;

whereby said container is collapsed by moving one corner diagonally through the cavity and folding the side assemblies together.

2. A collapsible containment system according to claim 1 further comprising hold down tabs attached to and extending outwardly of at least one of said side wall assemblies adjacent said bottom edge.

3. A collapsible containment system according to claim 1 further comprising lifting means secured to at least one of said side assemblies adjacent said upper seam thereof.

4. A collapsible containment system according to claim 1 wherein said woven liquid tight material is polypropylene.

5. A collapsible containment system according to claim 1 further comprising removable compartments.

* * * * *